US010350927B2

(12) United States Patent
Ito et al.

(10) Patent No.: US 10,350,927 B2
(45) Date of Patent: Jul. 16, 2019

(54) THERMAL TRANSFER IMAGE-RECEIVING SHEET

(71) Applicant: Dai Nippon Printing Co., Ltd., Tokyo (JP)

(72) Inventors: Hideo Ito, Tokyo (JP); Makoto Hashiba, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 15/764,496

(22) PCT Filed: Sep. 13, 2016

(86) PCT No.: PCT/JP2016/076990
§ 371 (c)(1),
(2) Date: Mar. 29, 2018

(87) PCT Pub. No.: WO2017/056970
PCT Pub. Date: Apr. 6, 2017

(65) Prior Publication Data

US 2018/0281494 A1 Oct. 4, 2018

(30) Foreign Application Priority Data

Sep. 30, 2015 (JP) ..... 2015-195233

(51) Int. Cl.
*B41M 5/382* (2006.01)
*B41M 5/41* (2006.01)

(52) U.S. Cl.
CPC ..... *B41M 5/38214* (2013.01); *B41M 5/41* (2013.01); *B41M 2205/32* (2013.01);
(Continued)

(58) Field of Classification Search
CPC ..... Y10T 428/24802; Y10T 428/24851; Y10T 428/24983
See application file for complete search history.

(56) References Cited

U.S. PATENT DOCUMENTS

2001/0034303 A1* 10/2001 Ueno ..... B41M 5/40 503/227
2008/0254382 A1* 10/2008 Haraguchi ..... B41M 5/345 430/200
2018/0281494 A1* 10/2018 Ito ..... B41M 5/38214

FOREIGN PATENT DOCUMENTS

JP H10-230684 A1 9/1998
JP 2001-162953 A1 6/2001
(Continued)

OTHER PUBLICATIONS

International Search Report and Written Opinion (Application No. PCT/JP2016/076990) dated Oct. 11, 2016.

*Primary Examiner* — Betelhem Shewareged
(74) *Attorney, Agent, or Firm* — Burr & Brown, PLLC

(57) ABSTRACT

Provided is a thermal transfer image-receiving sheet capable of suppressing the occurrence, inside a printer, of problems such as paper jam, printing failure, and abnormal sound. In a thermal transfer image-receiving sheet including a receiving layer on a substrate, the thermal transfer image-receiving sheet is provided with a perforation capable of being folded and torn off therealong; and the maximum resistance value is 0.5 N/cm or more and 1.0 N/cm or less as measured when the thermal transfer image-receiving sheet is folded along the perforation while one end side of the thermal transfer image-receiving sheet is being secured, and a predetermined force is being continuously applied to the other end side of the thermal transfer image-receiving sheet, the one end side and the other end side being situated across the perforation.

2 Claims, 3 Drawing Sheets

(52) U.S. Cl.
CPC ..... *Y10T 428/24802* (2015.01); *Y10T 428/24851* (2015.01); *Y10T 428/24983* (2015.01)

(56) References Cited

FOREIGN PATENT DOCUMENTS

| | | | |
|---|---|---|---|
| JP | 3082721 | U | 12/2001 |
| JP | 2002-274061 | A1 | 9/2002 |
| JP | 2013-123887 | A1 | 6/2013 |

* cited by examiner

THERMAL TRANSFER IMAGE-RECEIVING SHEET

TECHNICAL FIELD

The present invention relates to a thermal transfer image-receiving sheet.

BACKGROUND ART

There has hitherto been performed a thermal transfer method printing in which a thermal transfer sheet and a thermal transfer image-receiving sheet are superposed on each other, and the colorants on the thermal transfer sheet are transferred onto the thermal transfer image-receiving sheet. The image obtained by the thermal transfer method printing is excellent in the reproducibility and the gradation of halftone images, and is also extremely high definition, accordingly comparable with full color silver salt photographs, and thus undergoes growing demand.

In a thermal transfer image-receiving sheet used in such a thermal transfer method printing, sometimes provided is a perforation allowing folding and tear off therealong, as has been disclosed in Patent Literature 1 and Patent Literature 2. The provision of a perforation on a thermal transfer image-receiving sheet allows the tearing off along the perforation after printing, and thus, allows a "margin-less" print to be obtained.

CITATION LIST

Patent Literature

Patent Literature 1: Japanese Patent Laid-Open No. 2001-162953

Patent Literature 2: Japanese Patent Laid-Open No. 2002-274061

SUMMARY OF INVENTION

Technical Problem

However, when a thermal transfer image-receiving sheet provided with a perforation is used, a phenomenon in which a portion other than both ends of the perforation is unintentionally torn off inside a printer, the so-called "partial break of perforation" occurs, and thus problems such as a paper jam, a printing failure, and an abnormal sound sometimes are caused. Also, even when at least one end of the perforation is unintentionally torn off inside a printer, in the same manner as in the case of the occurrence of the "partial break of perforation," the problems such as a paper jam, a printing failure and an abnormal sound are caused.

The present invention has been made under such circumstances as mentioned above, and aims principally to provide a thermal transfer image-receiving sheet capable of suppressing inside the printer the occurrence of the problems such as a paper jam, a printing failure and an abnormal sound, and on the other hand, capable of being easily torn off along the perforation at an appropriate timing.

Solution to Problem

The present invention for solving the above-mentioned problems is a thermal transfer image-receiving sheet provided with a receiving layer on a substrate, wherein on the thermal transfer image-receiving sheet, provided is a perforation capable of being folded and torn off therealong, and the maximum resistance value is 0.5 N/cm or more and 1.0 N/cm or less as measured when the thermal transfer image-receiving sheet is folded along the perforation while one end side of the thermal transfer image-receiving sheet is being secured, and a predetermined force is being continuously applied to the other end side of the thermal transfer image-receiving sheet, the one end side and the other end side being situated across the perforation.

In the invention, when the perforation is viewed cross-sectionally, the form of the perforation may be such that the form of the perforation has a tapered form expanding from one surface toward the other surface of the thermal transfer image-receiving sheet, and the angle between the following two extended straight lines may be 15° or more and 35° or less; one of the two extended straight lines being obtained by extending the line section connecting the intersection between one of the internal wall surfaces of the perforation and one of the surfaces of the thermal transfer image-receiving sheet and the intersection between the one of the internal wall surfaces of the perforation and the other of the surfaces of the thermal transfer image-receiving sheet; and the other of the two extended straight lines being obtained by extending the line section connecting the intersection between the other of the internal wall surfaces of the perforation and the one of the surfaces of the thermal transfer image-receiving sheet and the intersection between the other of the internal wall surfaces of the perforation and the other of the surfaces of the thermal transfer image-receiving sheet.

Advantageous Effects of Invention

According to the thermal transfer image-receiving sheet of the present invention, because the perforation portion provided in the sheet concerned has an appropriate resistance value, the sheet concerned is free from the occurrence of the "partial break of perforation" inside a printer and the occurrence of the tearing off inside a printer, and is capable of suppressing the occurrence of the problems such as a paper jam, a printing failure, and an abnormal sound. On the other hand, at an appropriate timing, the paper of the thermal transfer image-receiving sheet can be easily torn off in the perforation portion by folding the perforation portion.

DESCRIPTION OF EMBODIMENTS

Figure 1:
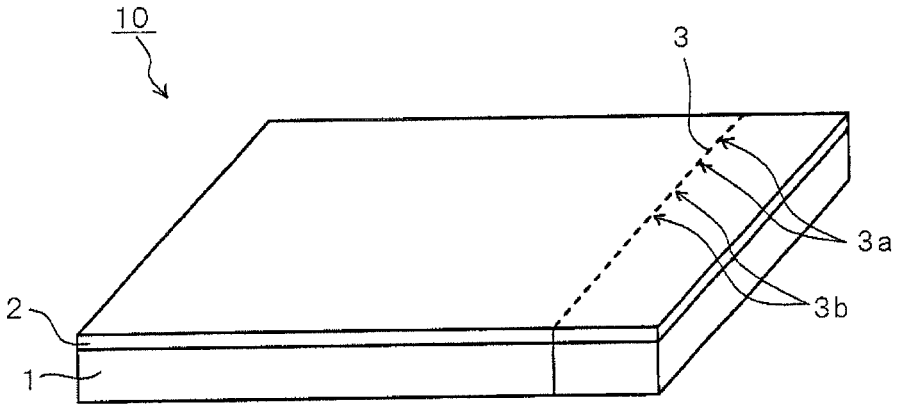
FIG. 1 is an oblique perspective view of the thermal transfer image-receiving sheet according to an embodiment of the present invention.

Hereinafter, the thermal transfer image-receiving sheets according to the embodiments of the present invention are described with reference to the accompanying drawings. It is to be noted that in the drawings, for the convenience of illustration and understanding, the dimensions of the actual objects are sometimes altered or exaggerated with respect to the scale reduction, the lengthwise and crosswise dimensions and the like.

FIG. 1 is an oblique perspective view of the thermal transfer image-receiving sheet according to an embodiment of the present invention.

As shown in FIG. 1, the thermal transfer image-receiving sheet 10 according to an embodiment of the present invention includes a receiving layer 2 on a substrate 1, and is provided with a perforation 3 capable of being folded and torn off. Hereinafter, the constituent members of the thermal transfer image-receiving sheet 10 are respectively described.

(Substrate)

The substrate 1 constituting the thermal transfer image-receiving sheet 10 desirably has a role of maintaining the receiving layer 2, and at the same time, has a mechanical property to resist to the heat applied during image formation and to be free from troubles in handling. Examples of such a material of the substrate may include, without being particularly limited to: films or sheets of the various plastics such as polyester, polyarylate, polycarbonate, polyurethane, polyimide, polyetherimide, cellulose derivatives, polyethylene, ethylene-vinyl acetate copolymer, polypropylene, polystyrene, acryl, polyvinyl chloride, polyvinylidene chloride, polyvinyl alcohol, polyvinyl butyral, nylon, polyether ether ketone, polysulfone, polyether sulfone, tetrafluoroethylene-perfluoroalkyl vinyl ether, polyvinyl fluoride, tetrafluoroethylene-ethylene, tetrafluoroethylene-hexafluoropropylene, polychlorotrifluoroethylene, and polyvinylidene fluoride.

As the substrate 1, white films prepared from the above-described resins and the materials obtained by adding a white pigment and a filler to these synthetic resins may also be used, or alternatively sheets having voids (microvoids) in the interior thereof may also be used. Examples of the sheet having voids (microvoids) in the interior thereof include, without being particularly limited to: polypropylene films such as trade name: TOYOPEARL (registered trademark) SSP4255 (thickness: 35 μm), manufactured by TOYOBO Co., Ltd. and trade name: MW247 (thickness: 35 μm), manufactured by Mobil Plastic Europe Inc.; and polyethylene terephthalate films such as trade name: W-900 (50 μm), manufactured by Mitsubishi Plastics, Inc., and trade name: E-60 (50 μm), manufactured by Toray Industries, Inc.

In addition to the aforementioned, the following may also be used: capacitor paper, glassine paper, parchment paper, synthetic papers (polyolefin-based, and polystyrene-based), high-quality paper, art paper, coated paper, cast-coated paper, synthetic resin or emulsion impregnated paper, synthetic rubber latex impregnated paper, synthetic resin intercalated paper, cellulose fiber paper and the like.

The substrate 1 constituting the thermal transfer image-receiving sheet 10 is not necessarily required to have a single layer structure, but may have a laminated structure prepared by bonding the aforementioned various materials through the intermediary of adhesive layers. In the case where the substrate 1 has a laminated structure, the substrate 1 can be prepared, for example, by using a core material such as a cellulose fiber paper or a plastic film, by using an adhesive layer, and by laminating synthetic papers or bonding materials having a cushioning property such as films having voids (microvoids) inside the base materials. In this case, the bonding material may be bonded either to one side or to both sides of the core material. The method for bonding is also not particularly limited, and as the method for bonding, for example, the following heretofore known methods can be used: dry lamination, wet lamination, non-solvent lamination, EC lamination and heat sealing. The adhesive layer may be applied either to the core material side or to the bonding material side; however, when a paper is used for the core material, the adhesive layer is preferably applied to the paper side in order to effectively conceal the texture of the paper. Moreover, a substrate obtained by subjecting the front face and/or the rear side of the substrate to an easy-to-adhere treatment such as a corona discharge treatment can also be used.

The adhesive layer used for forming the laminated structure of the substrate 1 is also not particularly limited, and heretofore known adhesive layers can be adopted appropriately as the adhesive layer concerned. As the adhesive constituting the adhesive layer, the following can be used: a urethane-based resin, polyolefin-based resins such as an α-olefin-maleic anhydride resin; a polyester-based resin, an acrylic resin, an epoxy-based resin, a urea-based resin, a melamine-based resin, a phenolic resin, and a vinyl acetate-based resin. Among these, a reaction-type acrylic resin and a modified acrylic resin can be preferably used. The curing of the adhesive by using a curing agent is preferable because such a curing improves the adhesion strength and increases the heat resistance. As the curing agent, isocyanate compounds are common; however, for example, an aliphatic amine, a cyclic aliphatic amine, an aromatic amine, and an acid anhydride ca be used. In the formation of the adhesive layer, commonly applied coating methods can be used; for example, coating is performed by a technique such as gravure printing, screen printing, or reverse roll coating using a gravure printing plate, and then by drying the coating layer, the adhesive layer can be formed.

(Receiving Layer)

As the receiving layer 2 constituting the thermal transfer image-receiving sheet 10, a receiving layer appropriately selected from the heretofore known various receiving layers can be used, without being particularly limited. For example, the receiving layer 2 is constituted by adding various additives such as a release agent, if necessary, to a varnish mainly composed of a resin easily receiving a transferred colorant or easily dyed with a colorant. Examples of the easily dyed resin may include: polyolefin resins such as polypropylene; halogenated resins such as polyvinyl chloride and polyvinylidene chloride; vinyl-based resins such as polyvinyl acetate, polyacrylic acid ester and other copolymers; polyester-based resins such as polyethylene terephthalate and polybutylene terephthalate; polystyrene-based resins; polyamide-based resins; copolymers between olefins such as ethylene and propylene and other vinyl-based monomers; ionomers; and monomers or mixtures of cellulose derivatives. Among these, polyester-based resins and vinyl-based resins are preferable.

The receiving layer 2 can include a release agent as mixed therein in order to prevent the thermal fusion with the thermal transfer sheet during the formation of an image. As the release agent, a silicone oil, a phosphoric acid ester-based plasticizer or a fluorine-based compound can be used, and among these, a silicone oil is preferably used. The addition amount of the release agent is preferably 0.2 part by mass or more and 30 parts by mass or less in relation to the receiving layer-forming resin. The release agent may be added to the receiving layer 2 as described above, but alternatively, may be formed additionally as a release agent by using the above-described materials on the surface of the receiving layer 2. In the receiving layer 2, if necessary, additives such as a fluorescent whitening agent and others may also be added. The coating for forming the receiving layer is performed by a common method such as roll coating, bar coating, gravure coating, and gravure reverse coating. The coating amount is preferably 0.5 $g/m^2$ or more and 10 $g/m^2$ or less (in terms of the solid content).

(Perforation)

In the thermal transfer image-receiving sheet 10 according to an embodiment of the present invention, a perforation 3 capable of being folded and torn off therealong is provided. As shown in FIG. 1, the perforation 3 is composed of the cut portions 3*a* as the through holes penetrating from one surface to the other surface of the thermal transfer image-receiving sheet 10, and the uncut portions 3*b* other than the cut portions.

Figure 2:
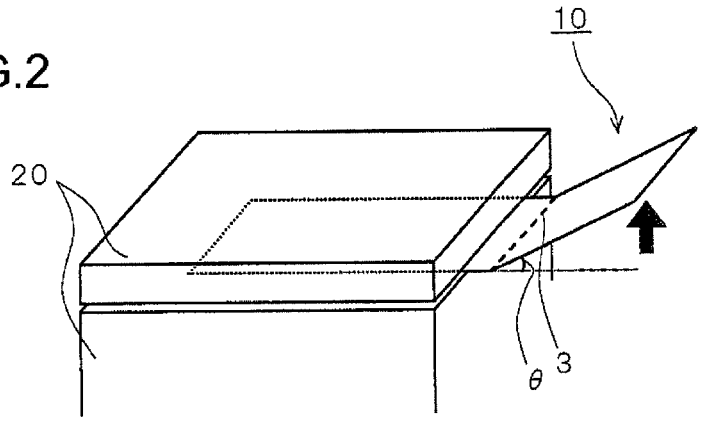
FIG. 2 is a schematic oblique perspective view for illustrating the method for measuring the resistance value of the perforation in the thermal transfer image-receiving sheet according to an embodiment of the present invention.

FIG. 2 is a schematic oblique perspective view for illustrating the method for measuring the resistance value of the perforation 3 in the thermal transfer image-receiving sheet 10 according to the present embodiment.

As shown in FIG. 2, in the thermal transfer image-receiving sheet 10 provided with the perforation 3, one end side (the left hand side in FIG. 2) across the perforation 3 is secured with a securing member 20. In this state, to the other end side of the thermal transfer image-receiving sheet 10, namely, to the side (the right hand side in FIG. 2) not secured with the securing member 20, a predetermined force is applied (see the arrow in FIG. 2) in such a way that the thermal transfer image-receiving sheet 10 is folded at the perforation 3 along the perforation 3 as a folding axis. Herein, a measurement apparatus is equipped with a measuring device (not shown) for measuring the folding angle θ in the portion of the perforation 3 and the resistance value received from the thermal transfer image-receiving sheet 10 in the state of being folded with the angle θ; thus, the measurement apparatus measures the folding angle θ and the resistance value at the folding angle concerned.

Examples of such a measurement apparatus include a bending stiffness tester BST-150M manufactured by Katayama Steel Rule Die Inc.

Figure 3:
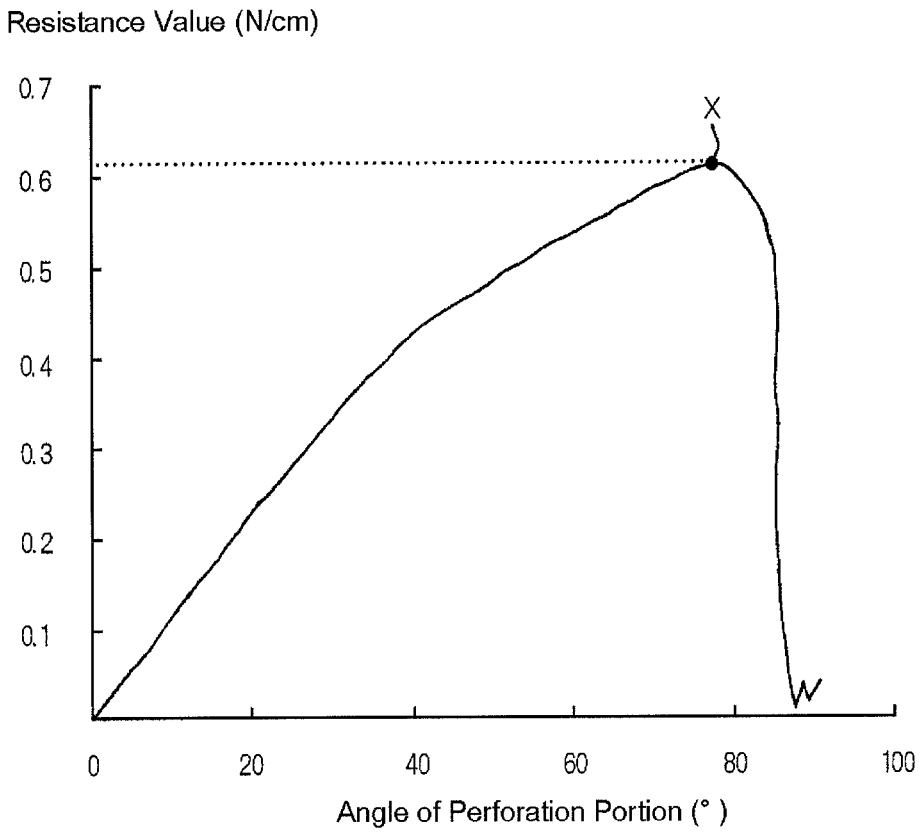
FIG. 3 is a graph showing the relation between the angle and the resistance value when the resistance value of the perforation portion of the thermal transfer image-receiving sheet according to an embodiment of the present invention was measured by using a bending stiffness tester (BST-150M).

FIG. 3 is a graph showing the relation between the angle and the resistance value when the resistance value of the perforation 3 portion of the thermal transfer image-receiving sheet 10 according to an embodiment of the present invention was measured by using the bending stiffness tester (BST-150M).

As shown in FIG. 3, when a predetermined force is applied in such a way that the thermal transfer image-receiving sheet 10 is folded at the perforation along the perforation as a folding axis, the resistance value received from the thermal transfer image-receiving sheet 10 is increased with the increase of the angle of the folding along the perforation 3. This is because the portion of the perforation 3 of the thermal transfer image-receiving sheet 10 has a predetermined rigidity, accordingly a reaction force works so as to maintain the sheet in a plateau to a maximum possible extent, and the reaction force is measured as the resistance value. When the folding angle at the perforation 3 exceeds a predetermined value, specifically, when the folding angle exceeds approximately 76° in the thermal transfer image-receiving sheet 10 shown in FIG. 3, the measured resistance value steeply decreases to 0 (zero). This means that the perforation 3 of the thermal transfer image-receiving sheet 10 cannot withstand the folding force so as to "fracture," and the resistance value reaches the maximum immediately before the fracture (see the point X in FIG. 3).

The thermal transfer image-receiving sheet 10 according to the embodiment of the present invention is characterized in that the maximum resistance value is 0.5 N/cm or more and 1.0 N/cm or less. The present inventors have paid attention to the causal relation between "the maximum resistance value" of the perforation 3 of the thermal transfer image-receiving sheet 10 and "the occurrence of the partial break of perforation inside the printer" or "the unintentional tearing off inside the printer," and discovered that these problems are solved by setting the maximum resistance value to be 0.5 N/cm or more and 1.0 N/cm or less.

By setting the maximum resistance value of the perforation 3 of the thermal transfer image-receiving sheet 10 to be 0.5 N/cm or more, the occurrence of "the unintentional tearing off inside the printer" can be suppressed, and the printing failure and the paper jam can be suppressed. On the other hand, by setting the maximum resistance value of the perforation 3 to be 1.0 N/cm or less, "the occurrence of the partial break of perforation inside the printer" can be suppressed, and the occurrence of the abnormal sound inside the printer can be suppressed. Because of such reasons, the maximum resistance value of the perforation 3 of the thermal transfer image-receiving sheet 10 is more preferably 0.6 N/cm or more and 0.95 N/cm or less, and particularly preferably 0.7 N/cm or more and 0.9 N/cm or less.

Here, the method for setting the maximum resistance value of the perforation 3 of the thermal transfer image-receiving sheet 10 so as to fall within the above-described numerical value range is not particularly limited. The maximum resistance value of the perforation 3 of the thermal transfer image-receiving sheet 10 can be regulated by appropriately regulating the various factors such as the constitution of the thermal transfer image-receiving sheet 10, the aforementioned material and thickness of the substrate 1, the aforementioned type and thickness of the receiving layer, the respective lengths of the cut portion 3*a* and the uncut portion 3*b* of the perforation 3, and moreover, the shape of the uncut portion 3*b* of the perforation 3.

It is to be noted that in the measurement of the maximum resistance value of the perforation 3, in the case where the one surface of the thermal transfer image-receiving sheet 10, such as the surface on the side on which the receiving layer 3 is formed is taken as the front face, and the other surface, such as the surface on the side on which the receiving layer is not formed is taken as the rear face, the folding toward the front face side and the folding toward the rear face side sometimes give different maximum values, and the maximum resistance value in the present description means the average value of the aforementioned two types of maximum resistance values actually separately measured.

Figure 4:
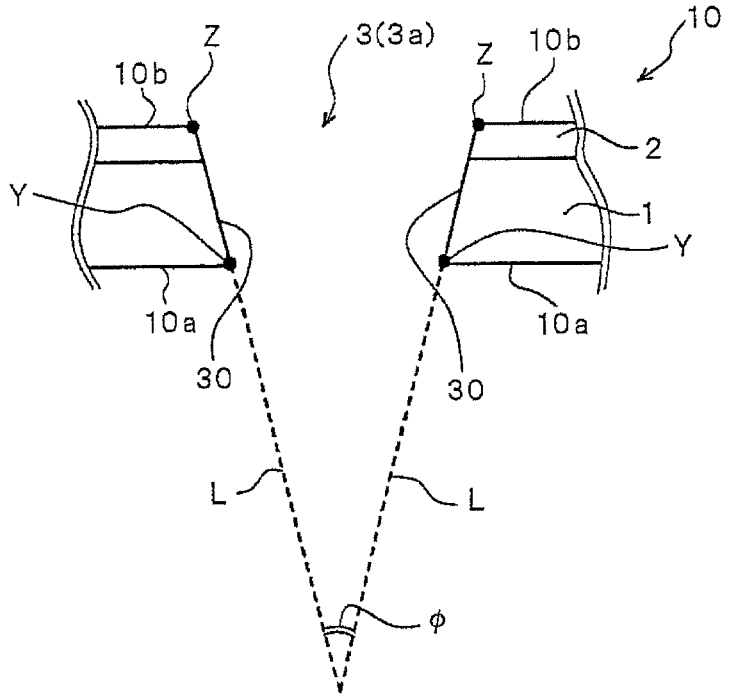
FIG. 4 is an enlarged cross sectional view of the perforation of the thermal transfer image-receiving sheet according to an embodiment of the present invention.

FIG. 4 is an enlarged cross sectional view of the perforation 3 of the thermal transfer image-receiving sheet 10 according to the present embodiment.

As shown in FIG. 4, in the thermal transfer image-receiving sheet 10 according to the present embodiment, when the perforation 3 is cross-sectionally viewed, the form of the cut portion 3*a* of the perforation 3 has a tapered shape expanding from one surface 10*a* toward the other surface 10*b* of the thermal transfer image-receiving sheet 10; the angle ϕ between the following two extended straight lines L and L is preferably 15° or more and 35° or less and further preferably 15° or more and 30° or less; one of the two extended straight lines L and L being obtained by extending the line section connecting the intersection Y between one internal wall surface 30 of the perforation 3 and one surface

10*a* of the thermal transfer image-receiving sheet and the intersection Z between the one internal wall surface 30 of the perforation 3 and the other surface 10*b* of the thermal transfer image-receiving sheet; and the other of the two extended straight lines L and L being obtained by extending the line section connecting the intersection Y between the other internal wall surface 30 of the perforation 3 and the one surface 10*a* of the thermal transfer image-receiving sheet and the intersection Z between the other internal wall surface 30 of the perforation 3 and the other surface 10*b* of the thermal transfer image-receiving sheet. In addition to the regulation of the maximum resistance value of the perforation 3 so as to fall within the predetermined range, by regulating the aforementioned angle ϕ so as to fall within the aforementioned numerical value range, "the unintentional tearing off" of the perforation 3 and "the partial break of perforation inside the printer" of the perforation 3 can be prevented more certainly, and at the same time, when the tearing off is performed by folding the perforation 3 at a desired timing, the tearing off can be performed smoothly.

Figure 5:
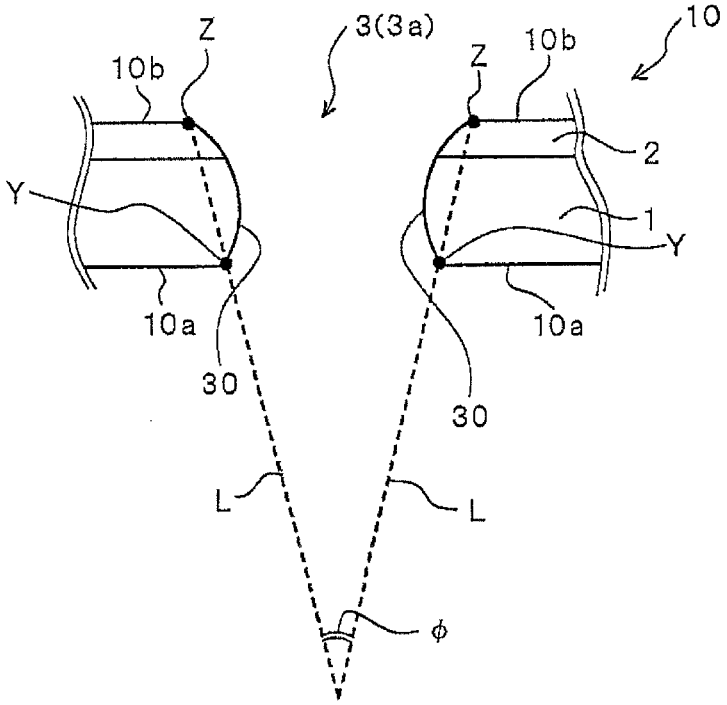
FIG. 5 is an enlarged cross sectional view of the perforation of the thermal transfer image-receiving sheet according to another embodiment of the present invention.

FIG. 5 is an enlarged cross sectional view of the perforation of the thermal transfer image-receiving sheet according to another embodiment of the present invention. It is to be noted that in FIG. 5, the same constitutional elements as in the thermal transfer image-receiving sheet shown in FIG. 4 are denoted by the same symbols.

The thermal transfer image-receiving sheet 10 shown in FIG. 5 is different from the thermal transfer image-receiving sheet shown in FIG. 4 in that the internal wall surfaces 30 and 30 of the perforation are not planes but are inwardly convex; the angle ϕ in such a case can be taken, as shown in FIG. 5, as the angle between the two extended lines L and L obtained by extending the line sections connecting the intersections Y and Y between the internal wall surfaces 30 and 30 of the perforation 3 and one surface 10*a* of the thermal transfer image-receiving sheet and the intersections Z and Z between the internal wall surfaces 30 and 30 of the perforation 3 and the other surface 10 *b* of the thermal transfer image-receiving sheet, respectively.

The method for setting the angle ϕ so as to be 15° or more and 35° or less is not particularly limited; the angle ϕ may be appropriately regulated by taking into account, for example, the constitution of the thermal transfer image-receiving sheet 10, the material and thickness of the aforementioned substrate 1, and the type and the thickness of the aforementioned receiving layer; however, for example, the angle of the blade for forming the perforation 3 may also be set to be 15° or more and 35° or less.

(Other Constitutions)

The thermal transfer image-receiving sheet 10 according to the embodiment of the present invention is not particularly limited with respect to the constitutions other than the substrate 1, the receiving layer 2, and the perforation 3, and may have other constitutions.

For example, an intermediate layer displaying various performances such as solvent resistance performance, barrier performance, adhesion performance, white color imparting performance, concealing performance, cushioning performance, and antistatic performance, may also be provided between the substrate 1 and the receiving layer 2; in such a case, an intermediate layer may be adopted by selecting from heretofore known various intermediate layers. A primer layer for improving the adhesiveness may be provided on the front face or the rear face of the substrate 1. Moreover, on the rear face of the substrate 1, namely, on the surface on the side on which the receiving layer 2 is not provided, a rear face layer may be provided in order to improve the transportability of the thermal transfer image-receiving sheet 10 and to prevent the curling of the thermal transfer image-receiving sheet 10.

It is to be noted that even when such an intermediate layer, such a primer layer and such a rear face layer are provided, these layers are required to be designed in such a way that finally the maximum resistance value of the perforation 3 falls within the predetermined range.

EXAMPLES

Hereinafter, Examples and Comparative Examples of the thermal transfer image-receiving sheet of the present invention will be described.

Example 1

A substrate was prepared by laminating a sheet of a polyethylene terephthalate film (trade name: Lumirror (registered trademark) 40EA3S, thickness: 40 μm, manufactured by Toray Industries, Inc.) on one surface of a sheet of a high-quality paper (basis weight: 157 g/m$^2$) by using a coating liquid for an adhesive layer, having the following composition in a coating density of 2.5 g/m$^2$ (in terms of the solid content), and by further laminating another sheet of the same polyethylene terephthalate film on the other surface of the sheet of the high-quality paper by using the same coating liquid as described above, in a coating density of 2.5 g/m$^2$ (in terms of the solid content). Subsequently, an intermediate layer was formed by applying a coating liquid for an intermediate layer having the following composition, with a bar coater in a dry coating density of 1.2 g/m$^2$, to the surface of one of the polyethylene terephthalate films in the resulting laminated substrate, and by drying the applied coating liquid with a dryer; then, a receiving layer was formed by applying a coating liquid for a receiving layer having the following composition, with a bar coater in a dry coating density of 4.0 g/m$^2$, by drying the applied coating liquid with a dryer, and by further drying the dried coating liquid in an oven set at 100° C. for 30 seconds. Then, a thermal transfer image-receiving sheet was obtained by forming a rear face primer layer and a rear face layer as follows: the rear face primer layer was formed by applying a coating liquid for a rear face primer layer having the following composition, with a gravure coater so as to result in a dry coating density of 1.2 g/m$^2$, to the polyethylene terephthalate film on the other surface side of the substrate, and by drying the applied coating liquid at 110° C. for 1 minute; and the rear face layer was formed by applying a coating liquid for a rear face layer having the following composition, with a gravure coater so as to result in a dry coating density of 2.0 g/m$^2$, to the resulting rear face primer layer, and by drying the applied coating liquid at 110° C. for 1 minute.

<Coating Liquid for Adhesive Layer>

Urethane resin: 30 parts (trade name: Takelac (registered trademark) A-969V, manufactured by Mitsui Takeda Chemicals Inc.)

Isocyanate: 10 parts (trade name: Takenate (registered trademark) A-5, manufactured by Mitsui Takeda Chemicals Inc.)

Ethyl acetate: 60 parts

<Coating Liquid for Intermediate Layer>

Polyester resin: 50 parts (trade name: Polyester (registered trademark) WR-905, manufactured by Nippon Synthetic Chemical Industry Co., Ltd.)

Titanium oxide: 20 parts
(trade name: TCA888, manufactured by Tochem Products Co., Ltd.)

Fluorescent whitening agent: 1.2 parts
(trade name: Uvitex BAC, manufactured by Ciba Specialty Chemicals Inc.)

Water: 14.4 parts

Isopropyl alcohol: 14.4 parts

<Coating Liquid for Receiving Layer>

Vinyl chloride-vinyl acetate copolymer: 60 parts
(trade name: Solbin (registered trademark) C, manufactured by Nissin Chemical Industry Co., Ltd.)

Epoxy-modified silicone: 1.2 parts
(tradename: X-22-3000T, manufactured by Shin-Etsu Chemical Co., Ltd.)

Methyl styryl modified silicone: 0.6 part
(trade name: X-24-510, manufactured by Shin-Etsu Chemical Co., Ltd.)

Methyl ethyl ketone: 2.5 parts

Toluene: 2.5 parts

<Coating Liquid for Rear Face Primer Layer>

Urethane resin: 100 parts
(trade name: OPT Primer, manufactured by Showa Ink Manufacturing Co., Ltd.)

Isocyanate-based curing agent: 5 parts
(trade name: OPT Curing Agent, manufactured by Showa Ink Manufacturing Co., Ltd.)

<Coating Liquid for Rear Face Layer>

Vinyl butyral resin: 10 parts
(trade name: Denka (registered trademark) Butyral 3000-1, manufactured by Denki Kagaku Kogyo K.K.)

Silicon dioxide: 0.75 part
(trade name: Sylysia 380, manufactured by Fuji Silysia Chemical Ltd.)

Titanium chelate: 0.117 part
(trade name: AT Chelating Agent, manufactured by Denka-polymer Kabushiki Kaisha)

In the thermal transfer image-receiving sheet, a perforation of 0.62 mm in the length of each of the cut portions and 0.23 mm in the length of each of the uncut portions was formed by using a blade having a blade angle of 25°, and thus, a thermal transfer image-receiving sheet of Example 1 was obtained.

It is to be noted that the angle $\phi$ (see FIG. 4 and FIG. 5) formed in the cut portion of the perforation in the thermal transfer image-receiving sheet of Example 1 was 25°.

Examples 2 to 4 and Comparative Examples 1 and 2

The same thermal transfer image-receiving sheets as the thermal transfer image-receiving sheet used in Example 1 were prepared, and by changing the blade for forming the perforation, obtained were the thermal transfer image-receiving sheets of Examples 2 to 4 and Comparative Examples 1 and 2 as shown in Table 1 presented below, having perforations different from each other in the length of the cut portion, the length of the uncut portion, and the angle formed by the cut portion of the perforation. It is to be noted that in Comparative Example 2, a commercially available thermal transfer image-receiving sheet was purchased, and accordingly, the length of the cut portion, the length of the uncut portion, and the angle $\phi$ formed by the cut portion of the perforation were not measured.

(Measurement of Maximum Resistance Value)

The maximum resistance value of the perforation of each of the thermal transfer image-receiving sheets of Examples 1 to 4 and Comparative Examples 1 and 2 was measured by using a bending stiffness tester BST-150M manufactured by Katayama Steel Rule Die Inc. It is to be noted that in the actual measurement, a measurement based on the folding toward the receiving layer formation side of the thermal transfer image-receiving sheet and a measurement based on the folding toward the side free from the formation of the receiving layer of the thermal transfer image-receiving sheet were both performed, and the average value of these two measured values was taken as the maximum resistance value. It is to be noted that in each of the thermal transfer image-receiving sheets of Examples 1 to 4 and Comparative Examples 1 and 2, the size was 68 mm in the lengthwise length×40 mm in the crosswise width, and the perforation was formed in parallel with the shorter side. The smaller area side across the perforation in each of the sheets was secured to the bending stiffness tester.

(Evaluation of Magnitude of Partial Break of Perforation)

The magnitude of the partial break of perforation was evaluated according to the following evaluation criteria for each of the thermal transfer image-receiving sheets of Examples 1 to 4 and Comparative Examples 1 and 2.

A: The magnitude of the partial break of perforation is 0 mm or more and less than 5 mm.

B: The magnitude of the partial break of perforation is 5 mm or more.

(Evaluation of Abnormal Sound)

The abnormal sound was evaluated according to the following evaluation criteria for each of the thermal transfer image-receiving sheets of Examples 1 to 4 and Comparative Examples 1 and 2.

A: The abnormal sound is not detected, or is small to a degree to be free from annoying.

B: The abnormal sound is large.

(Evaluation of Printing Failure)

The printing failure was evaluated according to the following evaluation criteria for each of the thermal transfer image-receiving sheets of Examples 1 to 4 and Comparative Examples 1 and 2.

A: The print is not affected.

B: The print has a few deficits to a level not causing any problems.

C: The print has defects to a problem-causing level.

(Evaluations of Paper Jam)

The paper jam was evaluated according to the following evaluation criteria for each of the thermal transfer image-receiving sheets of Examples 1 to 4 and Comparative Examples 1 and 2.

A: No paper jam occurs during the image printing, to normally complete the image printing.

B: The paper jam occurs during the image printing, and no normal image printing can be performed.

It is to be noted that the (Evaluation of abnormal sound), the (Evaluation of printing failure), and the (Evaluation of paper jam) were performed by using a DX-100 printer (manufactured by Sony Corp.) and the thermal transfer sheet for the DX-100 printer, and by conducting white solid image printing on the thermal transfer sheet of each of Examples and Comparative Examples.

Table 1 shows the features and the respective evaluation results of the thermal transfer image-receiving sheets of Examples 1 to 4 and Comparative Examples 1 and 2.

TABLE 1

| | Angle ϕ (°) | Cut portion (mm) | Uncut portion (mm) | Maximum resistance value (N/cm) | Magnitude of partial break of perforation | Abnormal sound | Printing failure | Paper jam |
|---|---|---|---|---|---|---|---|---|
| Example 1 | 25 | 0.62 | 0.23 | 0.85 | A | A | A | A |
| Example 2 | 25 | 0.72 | 0.23 | 0.71 | A | A | A | A |
| Example 3 | 20 | 0.62 | 0.23 | 0.90 | A | A | B | A |
| Example 4 | 17 | 0.73 | 0.25 | 0.74 | A | A | B | A |
| Comparative Example 1 | 50 | 0.25 | 0.23 | 0.13 | B | B | C | A |
| Comparative Example 2 | — | — | — | 0.40 | A | A | B | B |

As can be seen from the above-described results, the thermal transfer image-receiving sheets according to the embodiments of the present invention can suppress the occurrence of the problems such as the paper jam, the printing failure and the abnormal sound inside a printer.

REFERENCE SIGNS LIST

1 substrate
2 receiving layer
3 perforation
3*a* cut portion of perforation
3*b* uncut portion of perforation
10 thermal transfer image-receiving sheet
30 internal wall surface of cut portion of perforation

The invention claimed is:

1. A thermal transfer image-receiving sheet comprising a receiving layer on a substrate, wherein the thermal transfer image-receiving sheet is provided with a perforation capable of being folded and torn off; and the maximum resistance value is 0.5 N/cm or more and 1.0 N/cm or less as measured when the thermal transfer image-receiving sheet is folded along the perforation while one end side of the thermal transfer image-receiving sheet is being secured, and a predetermined force is being continuously applied to the other end side of the thermal transfer image-receiving sheet, the one end side and the other end side being situated across the perforation.

2. The thermal transfer image-receiving sheet according to claim 1, wherein when the perforation is cross-sectionally viewed, the form of the perforation has a tapered shape expanding from one surface toward the other surface of the thermal transfer image-receiving sheet; and the angle between the following two extended straight lines is 15° or more and 35° or less, the two extended straight lines being obtained by extending the straight line sections connecting the intersections between the internal wall surfaces of the perforation and one surface of the thermal transfer image-receiving sheet and the intersections between the internal wall surfaces of the perforation and the other surface of the thermal transfer image-receiving sheet, respectively.

* * * * *